United States Patent [19]

Robbins

[11] 4,026,236

[45] May 31, 1977

[54] WATER SKI LOCATING DEVICE

[75] Inventor: Roy F. Robbins, Cottage Grove, Minn.

[73] Assignee: Louis G. Ernster, Inver Grove Heights, Minn.

[22] Filed: Sept. 15, 1975

[21] Appl. No.: 613,349

[52] U.S. Cl. ..... 116/124 R; 116/124 B

[51] Int. Cl.[2] ..... A63C 15/06

[58] Field of Search ..... 9/310 A, 310 R, 9; 116/124 B, 124 R, 173, 174, 175; 403/229; 248/39

[56] References Cited

UNITED STATES PATENTS

| | | | |
|---|---|---|---|
| 2,496,158 | 1/1950 | Greenleaf | 403/229 |
| 2,716,531 | 8/1955 | Johnson | 403/229 |
| 3,044,435 | 7/1962 | Reardon | 116/173 |
| 3,169,739 | 2/1965 | Yacobian | 116/173 |
| 3,812,815 | 5/1974 | Kuenzel | 116/173 |
| 3,878,810 | 4/1975 | Conrad | 116/173 |

*Primary Examiner*—S. Clement Swisher
*Assistant Examiner*—Denis E. Corr
*Attorney, Agent, or Firm*—Stanley G. DeLaHunt

[57] ABSTRACT

A device for signaling the location of a floating water ski. A mounting means attaches to the ski edge and has a flexible mast extending in both the upwardly and downwardly vertical direction of the mounting means when attached. To the end of each section of the mast is attached a readily visible signal flag or the like. The masts flex to a rearwardly retracted position in response to water pressure as the ski moves through the water, but spring to the upright position when the ski lies still in the water.

3 Claims, 5 Drawing Figures

FIG. 1
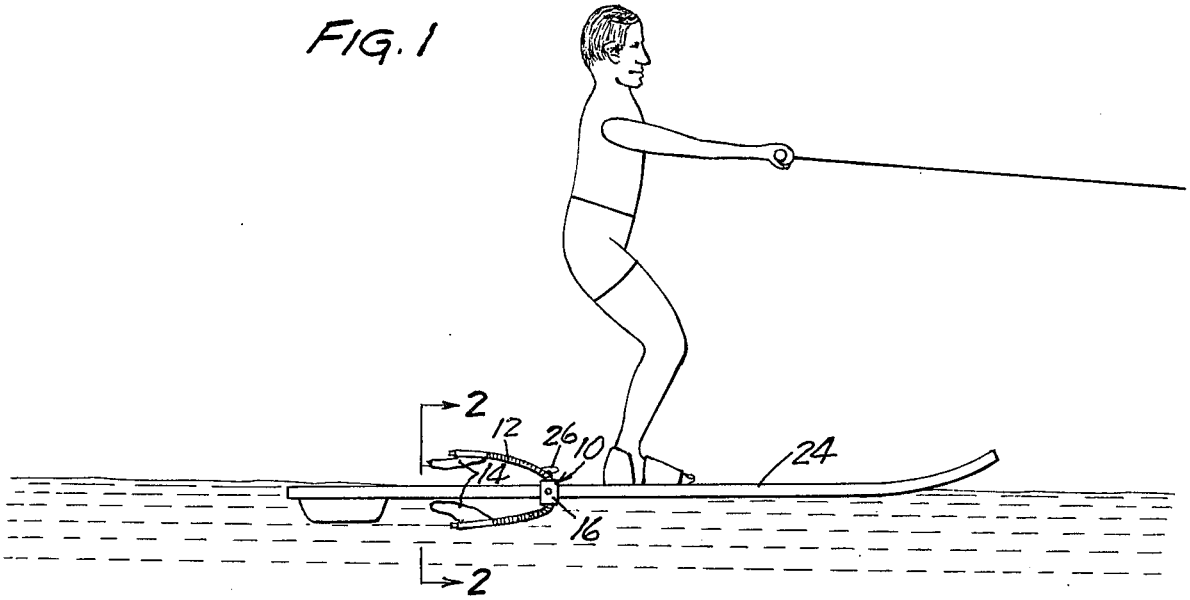
FIG. 2
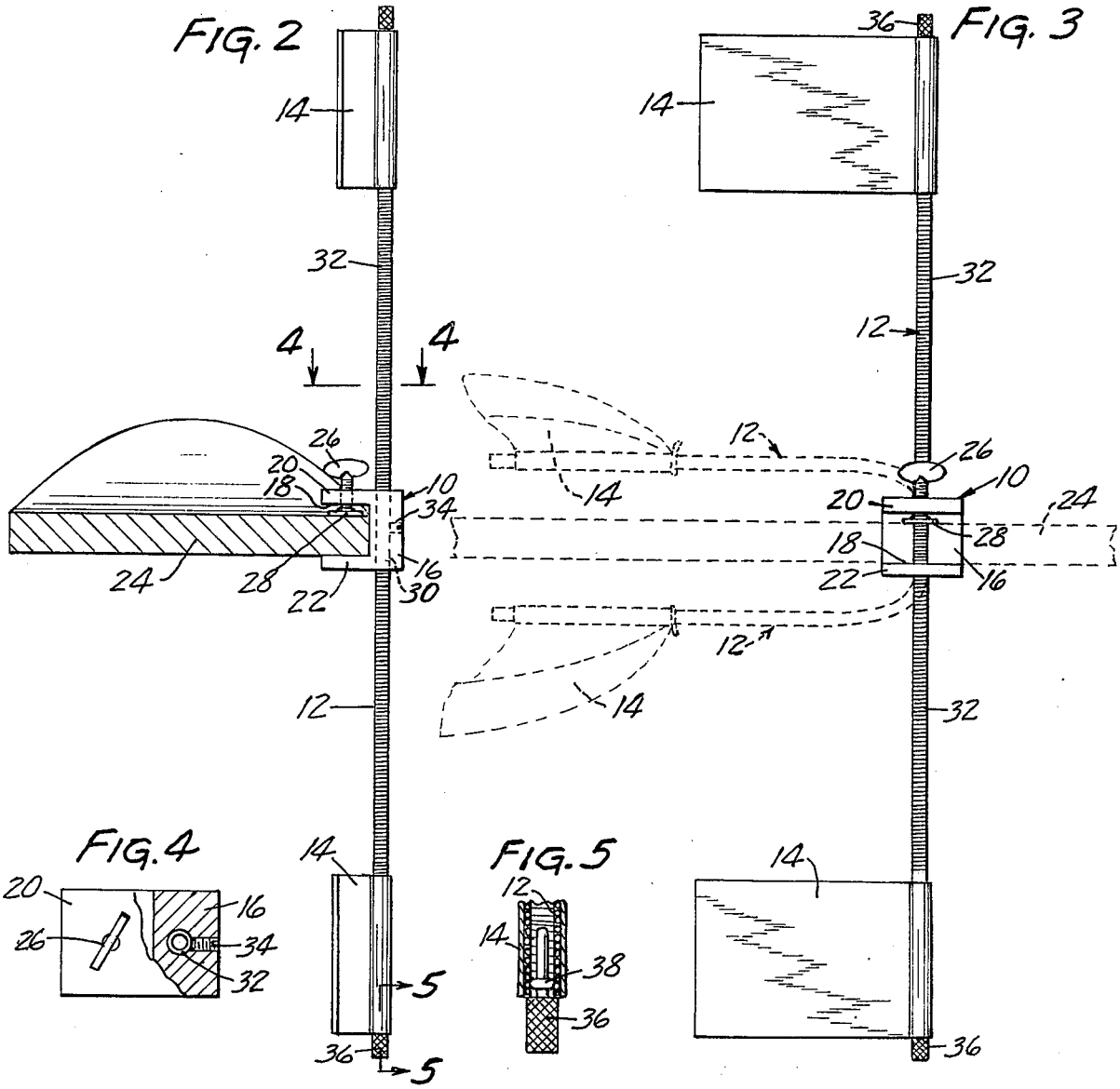
FIG. 3
FIG. 4
FIG. 5

WATER SKI LOCATING DEVICE

The present invention relates to a signal or marking device for locating water skis which have become separated in the water from a fallen skier.

For reasons of safety and ease of attachment, the binding means by which water skis are attached to the feet of the skier are so designed that they readily come loose when the skier falls in the water. By the time a tow boat has circled around to retrieve the fallen skier, the skis lying in the water have usually separated some distance from the skier and are often difficult to locate. This is particularly true where the water is choppy. During the interval when the ski is lying free in the water, it presents a hazard not only to the boat seeking to retrieve it but to other traffic as well.

The present invention is directed to provision of a simple inexpensive device which offers little or no impediment to the ski or skier during travel through the water in use, but presents a readily visible signal once the ski is released and lies still in the water. The manner in which the objectives of my invention are accomplished will be readily apparent from the following description, wherein like reference characters refer to corresponding parts in the several views, and in which:

FIG. 1 is a side elevation of a skier traveling through the water on a ski containing my novel device;

FIG. 2 is a section view of a ski from the rear thereof showing one embodiment of my device mounted in place;

FIG. 3 is a side view of the signal device of FIG. 2 viewed from the interior of the ski;

FIG. 4 is a section view taken along the lines 4—4 of FIG. 2; and

FIG. 5 is a section view taken along the lines 5—5 of FIG. 2.

Referring now to the drawings, a preferred embodiment of the present invention is seen to comprise an attachment means 10 and flexible mast 12, to the extremities of which are attached a pair of signal flags 14. The attachment means 10 may be formed of a shaped metal block 16 having a machined lateral indentation 18 defined by laterally extending upper and lower projections 20 and 22, the indentation 18 having a thickness between said projections somewhat greater than the thickness of a conventional water ski 24 at the point of attachment generally at the midsection thereof. Threaded through the upper projection 20 is a thumbscrew 26 having a bearing plate 28 moveably centered on the shaft thereof. The attachment means 10 is thus releasably fastened to the ski 24 by inserting block 16 onto one lateral edge of the ski, said edge extending into indentation 18 between the inner surface of lower projection 22 and pressure plate 28, and tightening thumbscrew 26 to hold the ski.

The block 16 also contains a boring 30 in the vertical direction, that is, transverse to the plane of the ski 24, through which boring is passed a flexible elongate closely wound spiral spring 32 which forms mast 12. The spring is centered along its length in relation to block 16 and held in place by a set screw 34 turned into the exterior lateral surface of block 16 opposite indentation 18.

On each outer end of the spring 32 is disposed a flag 14 made, for example, of cloth or plastic dyed or colored with a readily visible color such as a fluorescent or iridescent orange. The flag 14 is constructed with a seamed casing or envelope at one end extending snugly over the end of the spring 32. Into the open end of the spring is then inserted an expansion plug 36 having an enlarged radially extending protrusion 38 which expands the end of the spring 32 so as to secure the flag 14 in place (FIG. 5).

In use, the block is attached to the side edge of the ski as above described, as shown in FIG. 1, for example, just to the rear of the ski binding. The flexibility of the mast 12, due to the nature of the spring 32 of which it is constructed, allows the mast to bend rearwardly as the skier moves through the water in response to the force thereof, as shown in FIG. 1 and on dotted lines in FIG. 3. Thus, my device presents a relatively small amount of frictional drag in use. However, when the skier falls and the ski stops "dead" in the water, the resiliency of the spring 32 causes it to extend straight, and the flag thus to extend vertically. No matter whether the ski lies in the water right side up or upside down, one end of the flag will protrude, making the ski readily locateable both to the towing craft as it circles around to pick up the skier and the skis; and also to serve as a warning to other watercraft in the area. Because of its readily flexible nature, the flag device presents little or no hazard to the fallen skier, as the mast will simply bend out of the way should the skier fall upon it.

While my invention has been described with reference to a specific construction, it can be readily appreciated that other forms of materials can be used. For example, other forms of metal or plastic clamping mechanisms can be employed as the attaching means, and other flexible materials, for example, rubber or the like, can be used for the mast, or both the attaching means and mast could be formed of a single flexible resilient material. By the same token, various types of signaling means can be employed in place of the preferred flags, such, for example, as colored spheres or signal lights or the like. All of these modifications are contemplated as equivalents.

What I claim is:

1. A device for signaling the location of a floating water ski comprising:

mounting means for attaching the device to the lateral edge of a water ski, a flexible mast extending from both the upper and lower surfaces of said mounting means when attached, and signal means positioned at each extremity of said mast, said mast flexing to a rearwardly retracted position in response to water pressure generated during movement of the ski through the water in use and springing to the upright position when the ski lies still in the water.

2. A water ski having the signal device of claim 1 affixed generally centrally thereof.

3. A device for signaling the location of a floating water ski comprising:

mounting means for attaching the device to the lateral edge of a water ski, a flexible mast extending in opposite directions from said mounting means transversely to the plane of the ski when said mounting means is attached, and signal means positioned at each extremity of said mast, said mast flexing to a rearwardly retracted position in response to water pressure generated during movement of the ski through the water in use and springing to the upright position when the ski lies still in the water.

* * * * *